United States Patent [19]

Phillips

[11] 4,260,276

[45] Apr. 7, 1981

[54] GEODESIC DOME CONNECTOR

[76] Inventor: Martha E. Phillips, 3906 Ridgecroft Rd., Baltimore, Md. 21206

[21] Appl. No.: 140,854

[22] Filed: Apr. 16, 1980

[51] Int. Cl.[3] ..... F16B 7/00

[52] U.S. Cl. ..... 403/172; 52/80

[58] Field of Search ..... 403/169, 170, 171, 172, 403/173, 174, 175, 176, 177, 178; 52/80, 81

[56] References Cited

U.S. PATENT DOCUMENTS

| | | | |
|---|---|---|---|
| 3,186,522 | 6/1965 | McCauley | 52/81 |
| 3,688,461 | 9/1972 | Eberhard | 403/174 X |

FOREIGN PATENT DOCUMENTS

| | | | |
|---|---|---|---|
| 566865 | 2/1960 | Belgium | 403/172 |

*Primary Examiner*—Andrew V. Kundrat

*Attorney, Agent, or Firm*—John F. McClellan, Sr.

[57] ABSTRACT

A geodesic dome connector system includes a central ring of symmetrical truncate-pyramid shape having on respective facets thereof respective pairs of laterally opposed jaws radiating from the center; inclination of the facets perpendicular to the intended chords of the dome structure automatically aligns the rectangular-end jaws along the chords and fairs-in the top and bottom surfaces of the ring and the jaws with conventional elongate members held by the jaws and with any conventionally applied sheathing panels used in completing the dome; and close-coupling of the connector elements according to the design of the invention maximizes rigidity and strength while minimizing weight and cost.

2 Claims, 2 Drawing Figures

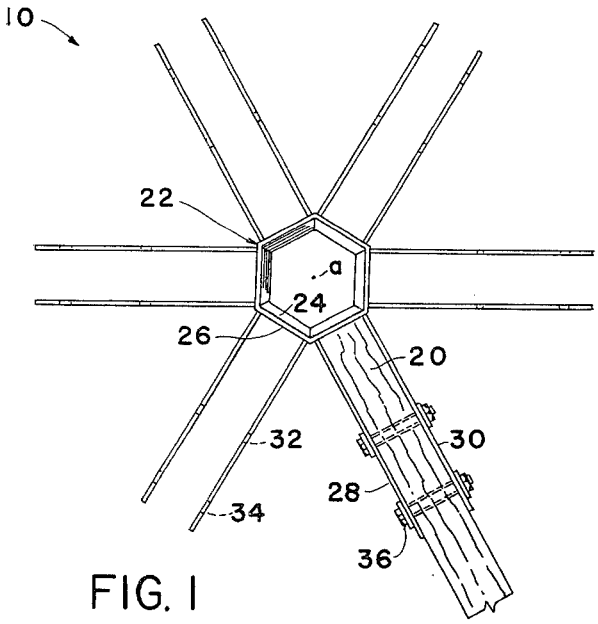
FIG. 1
FIG. 2
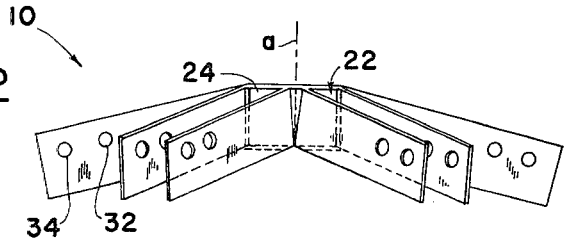

GEODESIC DOME CONNECTOR

Cross reference is made to my copending U.S. Pat. application Ser. No. 122,988 filed Feb. 20, 1980 for GEODESIC DOME STRUCTURE TIE-BEAM CONNECTOR.

This invention relates generally to geodesic domes and particularly to geodesic dome connectors for the elongate members.

In the prior art numerous connectors for the purpose have been disclosed, including connectors having a central ring with laterally-opposed paired jaws radiating from it on respective ends of radial arms, as in U.S. Pat. No. 3,186,522 issued to G. W. McCaulay on 6-1-65.

However, a principal object of the present invention is to provide a simpler and more economical and lightweight structure having many of the advantages of the McCaulay device and additional advantages in rigidity, strength, low cost and improved appearance.

Further objects are to provide a structure as described in which less material and fewer joinings in fabrication are necessary; in which a novel truncated-pyramid ring permits the use of square-cut ends in the jaws where they join the ring, making correct-angle alignment automatic in welding fabrication, which adapts easily to six, five, four and three leg embodiments, and which provides easy access to installation and for inspection.

A furher important object is to provide a connector system in which a central polygonal ring has inclined top and bottom surfaces fairing-in with the correcponding surfaces of a corresponding plurality of sets of jaws.

In brief summary given as cursive description only and not as limitation, the invention includes a central ring in truncate pyramid form and having respective pairs of laterally opposed jaws extending at right angles from respective facets of the pyramidal shape in generally radial directions therefrom.

The above and other objects and advantages of this invention will become more readily apparent on examination of the following description, including the drawings, in which:

FIG. 1 is a top plan fragmentary view of a connector according to this invention in use holding elongate members of a geodesic dome structure; and FIG. 2 is a side elevational view.

FIG. 1 shows the invention 10 in use, as comprising a connector in a geodesic dome structure holding conventional chord-deployed elongate members 20 at a juncture typical of geodesic dome locations where a plurality of elongate members converge along respective chords.

The connector includes a truncate-pyramidal central ring 22. In this case it has six sides or facets 24 symmetrical about axis a passing perpendicularly through the ring.

Base of the ring, represented by the long edges 26 of the facets, is outward relative to the geodesic dome, as installed, similarly the truncate end is the inner end.

Centrally located on each facet is a pair of laterally opposed jaws 28, 30; these may be in the form of rectangular flat strips extending perpendicularly from the facet.

Each pair of jaws has a pair of bolt holes 32, 34 extending perpendicularly therethrough and through the respective elongate member to receive bolts 36, preferably having washers under the head and the nut, for compressing the pairs of jaws on the elongate member and holding it.

Access for the bolts is provided by spacing the bolt holes sufficiently away from the ring for insertion of the bolts. Preferably the boltholes are in spaced longitudinal relation along the jaws.

The unit may be cast, or welded together, as desired. One-eighth inch thick aluminum may be sufficient for the usual applications.

It can be seen that the hexagonal shape shown will serve for junctions requiring six or three pairs of jaws. Five member junctions would require a pentagonal truncate-pyramid shape and four member junctions similarly a square shape.

Clearance in these other embodiments would be as good as or better than in the hexagonal embodiment, and it is evident that symmetry would tend in all cases to spread the loads and minimize localization of stresses. Although the ring could be made assymetrical to suit special situations symmetry is preferred.

FIG. 2 shows in side elevational view the connector of FIG. 1.

The inclination from the axis a of each of the facets 24 in the truncate-pyramidal shape of the ring 22 is made perpendicular to the desired chord between connectors in the particular size dome.

Particularly if the unit is made of welded together rectangular plates, this feature can automatically produce several benefits. It can automatically align the rectangular jaws with the appropriate chord so that the base end and the truncate end surfaces of the rings are in-plane with or flush with the respective contiguous inner and outer edge surfaces of the jaws, which are then also automatically-flush or in-plane with the elongate members, providing for flush-fit of sheathing panels along these surfaces.

As shown also, the bolt holes 32, 34 may be but need not be upwardly displaced from the long centerline of the jaws, as for example tangent to the longitudinal centerline, providing greater compression toward the top.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by U.S. letters patent is:

1. In a system for geodesic dome connection of chord-deployed elongate members at a juncture, including an axis-symmetrical connector having pairs of jaws radiating in directions away from a central ring of polygonal shape, the improvement comprising: the central ring having the shape of a truncate-pyramid with base end and truncate end, the truncate-pyramid shape having respective facets about an axis, said facets inclined respectively at right angles to the direction of chords of chord-deployed elongate members to be connected to said system, respective pairs of laterally opposed jaws extending at right angles in generally radial direction from integral connection directly with respective said facets, and means for compressing each pair of jaws on an elongate member.

2. In a system as recited in claim 1, said jaws having respective outer and inner edge surfaces, said base end and truncate end of the central ring respectively being in-plane with the respective outer and inner edge surfaces of the jaws, and the means for compessing including the jaws having a plurality of bolt holes passing therethrough.

* * * * *